US007766152B2

(12) United States Patent
Damen

(10) Patent No.: US 7,766,152 B2
(45) Date of Patent: Aug. 3, 2010

(54) FREEZE DRYER

(75) Inventor: Franciscus Damen, Langeweg (NL)

(73) Assignee: Ima Life S.R.L., Ozzano Dell'Emilia (IT)

( * ) Notice: Subject to any disclaimer, the term of this patent is extended or adjusted under 35 U.S.C. 154(b) by 371 days.

(21) Appl. No.: 11/628,694

(22) PCT Filed: Jun. 6, 2005

(86) PCT No.: PCT/GB2005/002209

§ 371 (c)(1),
(2), (4) Date: Sep. 24, 2007

(87) PCT Pub. No.: WO2005/121672

PCT Pub. Date: Dec. 22, 2005

(65) Prior Publication Data

US 2008/0134537 A1 Jun. 12, 2008

(30) Foreign Application Priority Data

Jun. 11, 2004 (GB) ..... 0413115.7

(51) Int. Cl.
*B65G 47/34* (2006.01)

(52) U.S. Cl. ..... 198/370.07; 198/429; 198/736; 198/747; 414/214; 34/92

(58) Field of Classification Search ..... 198/370.07, 198/429, 736, 738, 747; 414/214; 34/92
See application file for complete search history.

(56) References Cited

U.S. PATENT DOCUMENTS 3,516,469 A * 6/1970 McDonald ..... 160/26
5,038,916 A * 8/1991 Quilliou ..... 198/429
5,129,162 A * 7/1992 Hemmersbach et al. ..... 34/284
5,551,821 A 9/1996 Hall et al.
5,971,132 A * 10/1999 Bonnet ..... 198/370.07
6,931,754 B2 * 8/2005 Sennhenn et al. ..... 34/75
2006/0263179 A1 * 11/2006 Selch ..... 414/222.01

FOREIGN PATENT DOCUMENTS

DE 29 42 583 4/1981
DE 44 24 287 A1 1/1996

(Continued)

OTHER PUBLICATIONS

EPO International Search Report; Completed Aug. 1, 2005; Authorized Officer: H. Silvis.

(Continued)

*Primary Examiner*—Mark A Deuble
(74) *Attorney, Agent, or Firm*—Knobbe Martens Olson & Bear LLP

(57) ABSTRACT

A freeze dryer comprises a chamber having a rectangular slot through which vials are inserted into the chamber. An assembly for loading the chamber comprises a bar extending across the slot to engage vials to be inserted into the chamber. The bar is attached to a mechanism for moving the bar laterally into and out from the chamber. In a retracted position of the bar, at least part of the mechanism is wound around a sprocket. Rotation of the sprocket unwinds the mechanism to move the bar into the chamber.

18 Claims, 8 Drawing Sheets

FOREIGN PATENT DOCUMENTS

| | | | |
|---|---|---|---|
| DE | 201 02 879 | | 10/2001 |
| DE | 203 06 925 | | 8/2004 |
| DE | 103 07 571 | | 9/2004 |
| FR | 2 643 346 | A | 8/1990 |
| GB | 697 925 | | 9/1953 |
| WO | WO 96/35090 | | 11/1996 |
| WO | WO 2004/074143 | | 9/2004 |

OTHER PUBLICATIONS

Great Britain Search Report Under Section 17; Completed Oct. 20, 2004; Authorized Officer: Mr. Rupert Knights.

* cited by examiner

FREEZE DRYER

FIELD OF THE INVENTION

The present invention relates to an assembly for loading or unloading a freeze dryer or the like.

BACKGROUND OF THE INVENTION

Freeze dryers typically incorporate a pressure vessel having a freeze drying chamber for receiving a plurality of containers or vials typically containing sterile material to be freeze dried. Access to the chamber for automated loading and removal of vials is through a rectangular opening, or slot, formed in a wall or in the main door of the chamber. The slot is closed by a slot door which, with the chamber, forms a vacuum seal around the slot.

To enable vials to be inserted into the chamber, the slot door is vertically raised relative to the slot by moving the slot door along guide tracks. A loading mechanism provided opposite the slot door pushes vials from a conveyor on to a shelf of the chamber. The vials may be loaded row by row on to a shelf, a number of rows at a time, or a complete shelf full at a time. The loading mechanism is subsequently withdrawn and the slot door closed to enable the contents of the vials to be freeze dried. The vials can be subsequently removed from the chamber, typically in the same manner (row by row or shelf by shelf) as they were loaded into the chamber, using an unloading mechanism.

Pharmaceutical freeze dryers are usually at least partially housed in a clean room, with the loading and unloading mechanism being located in a sterile environment, for example an isolator, adjacent the clean room environment. The size of these loading and unloading mechanisms can contribute greatly to the overall size of the foot-print of the freeze dryer. As the cost of maintaining the sterile environment generally increases with size, conventional loading and unloading mechanisms, typically requiring around 2 $m^2$ and 1 $m^2$ of floor space respectively, can significantly increase running costs.

SUMMARY OF THE INVENTION

An embodiment of the present invention is to provide a mechanism for loading or unloading a freeze dryer which can significantly reduce the size of the overall foot-print of the freeze dryer.

In a first aspect, the present invention provides an assembly for loading vials into or unloading vials from a chamber of a freeze dryer or the like, the assembly comprising a bar for engaging vials, and means for effecting lateral movement of the bar, characterised in that, in a retracted position of the bar, at least part of the moving means is wound around a wheel, the assembly comprising drive means for rotating the wheel to unwind the moving means from the wheel and effect the movement of the bar.

As used herein, the term "wheel" connotes any structure rotatable about an axis.

The invention can thus provide a compact assembly for unloading vials from, or loading vials into, a chamber of a freeze dryer, which can significantly reduce the overall size of the foot-print of the freeze dryer.

In order to provide a compact assembly, a greater proportion of the moving means is wound around the wheel in the retracted position of the bar than in an extended position of the bar. In the retracted position, the moving means is preferably wound at least 180° around the wheel, more preferably at least 270° around the wheel.

Said at least part of the moving means preferably comprises a chain or other plurality of linked members wound about the wheel, the chain being attached to a pusher head for engaging the bar. In the preferred embodiment, the linked members are hinged together, and are in the form of tubular members hinged at each end thereof to a respective adjacent tubular member. With this structure, wires or the like for supplying control signals to the drive means for the wheel can be conveniently passed through the tubular members. The wheel is preferably in the form of a sprocket, having a plurality of radially extending teeth profiled to receive the hinges of the chain.

The assembly preferably comprises guide means for guiding the moving means during rotation of the sprocket. The guide means may be arranged to align the members of the chain relative to the bar, for example, orthogonally thereto, as they are unwound from the sprocket. The guide means may comprise a guide track extending about at least part of the sprocket, the chain carrying a plurality of rollers for engaging the guide track. For example, a roller may be provided at or towards one end of each tubular member.

In order to isolate the sprocket and drive means from the sterile environment of an isolator or the like, the sprocket and drive means are preferably located within a housing having an opening through which the moving means passes during rotation of the wheel. Bellows or the like may be provided to isolate the chain from the ambient atmosphere as it passes through the opening with rotation of the sprocket. These bellows may be conveniently formed from plastics material.

The present invention also provides a freeze dryer comprising a chamber and at least one assembly as aforementioned. One assembly may be provided on one side of the chamber for loading vials into the chamber, and another assembly may be provided on the other side of the chamber for unloading vials from the chamber.

BRIEF DESCRIPTION OF THE DRAWINGS

Preferred features of the present invention will now be described with reference to the accompanying drawings, in which.

DETAILED DESCRIPTION OF THE INVENTION

Figure 1:
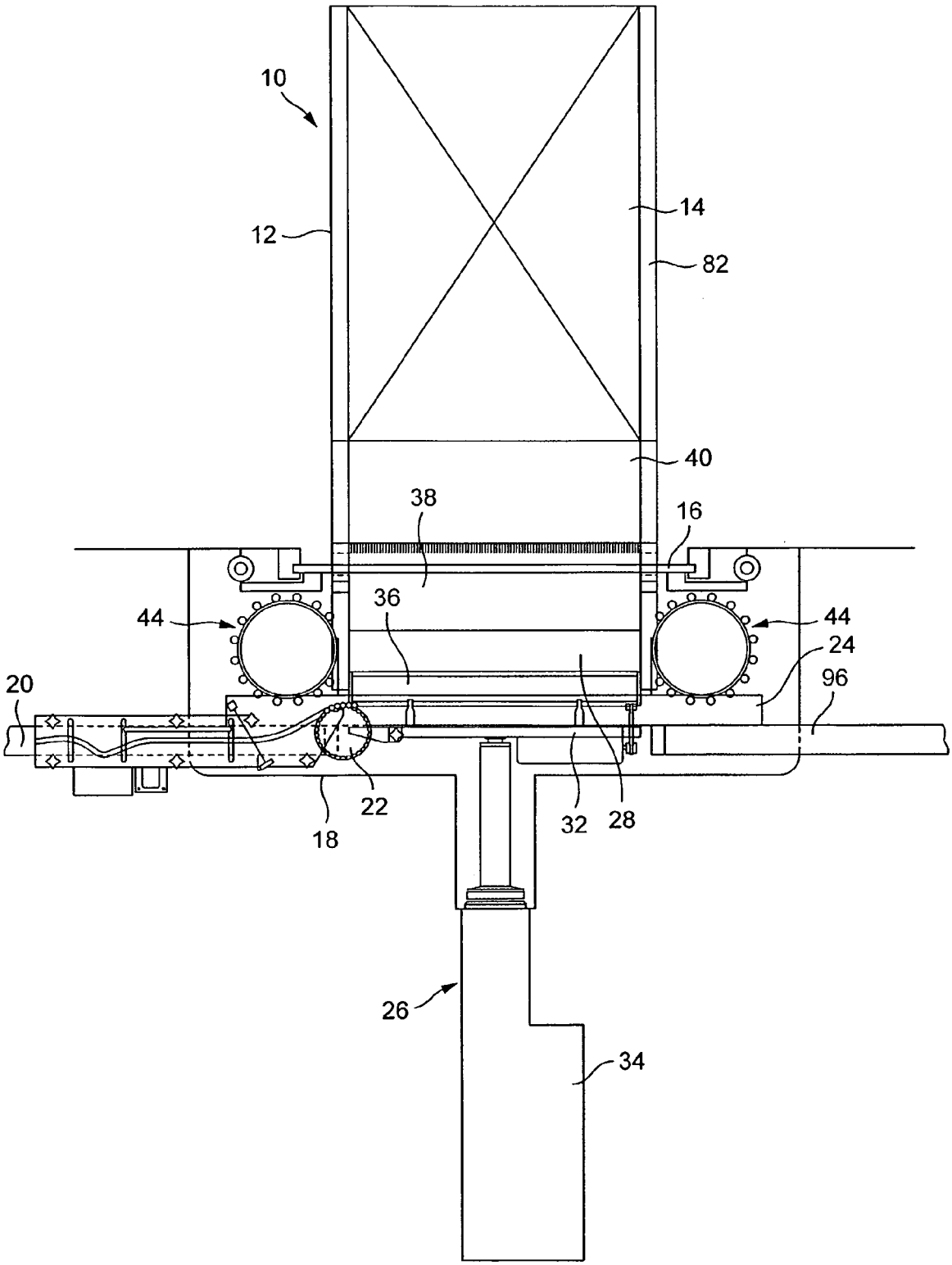
FIG. 1 is a plan view of a first embodiment of a freeze dryer.

With reference to FIG. 1, a freeze dryer 10 comprises a chamber 12 having a slot (not shown) formed in the front wall of the chamber 12 to enable vials to be loaded on to and unloaded from a shelf 14 in the chamber 12. The slot can be closed by a slot door 16 moveable relative to the chamber 12. The chamber 12 includes a number of shelves 14, each of which can be raised and lowered within the chamber 12 using a shelf location mechanism (not shown). To load the shelves, the shelves are initially collapsed in the lower portion of the chamber, and the uppermost shelf is first moved into a loading position. After that shelf has been loaded, the mechanism automatically raises the loaded shelf to enable the next shelf to be moved to the loading position. This moving sequence continues until the chamber loading has been completed. To unload the chamber, the loading sequence is reversed, with the lowermost shelf being unloaded first.

An assembly for loading and unloading the chamber 12 is formed from several modules supported by a supporting frame located in an isolator cabinet 18. The assembly enables automated loading of the freeze dryer 10 with vials received from a filling machine, and automated unloading of those vials from the freeze dryer for subsequent conveyance to a capping machine.

The supporting frame is bolted to the frame of the freeze dryer 10, and to the floor of the isolator. The supporting frame is formed from strong stainless steel plates. Within the isolator 18, the external surfaces of the supporting frame and the modules of the assembly for loading and unloading the chamber are designed so as to be readily accessible for cleaning and sterilising in situ using, for example, vaporised hydrogen peroxide.

The modules of the assembly for loading and unloading the chamber 12 will now be described.

An in-feed conveyor 20 collects the vials coming from a filling machine (not shown) located outside the isolator and conveys the vials to an in-feed star wheel 22 mounted on the supporting frame. Appropriate guiding ensures a smooth transition between the in-feed conveyor 20 and the in-feed star wheel 22 with correct feeding of the in-feed star wheel 22. For small vials subject to tipping, a mechanical reject system may be provided upstream from the in-feed star wheel 22 to reject fallen vials. The in-feed conveyor 20 is driven by a motor located beneath the supporting frame.

The in-feed star wheel 22 serves to position the vials received from the in-feed conveyor on to a pusher conveyor 24. The in-feed star wheel 22 and the pusher conveyor 24 are driven by respective servomotors located beneath the supporting frame. The rotational speed of the in-feed star wheel 22 can be synchronised with the speed of the pusher conveyor 24. Control of the starting, acceleration, deceleration and stopping of the in-feed star wheel 22 relative to the pusher conveyor 24 can be used to convey the required number of vials on to the pusher conveyor 24 and to control the pitch of those vials.

Figure 2A:
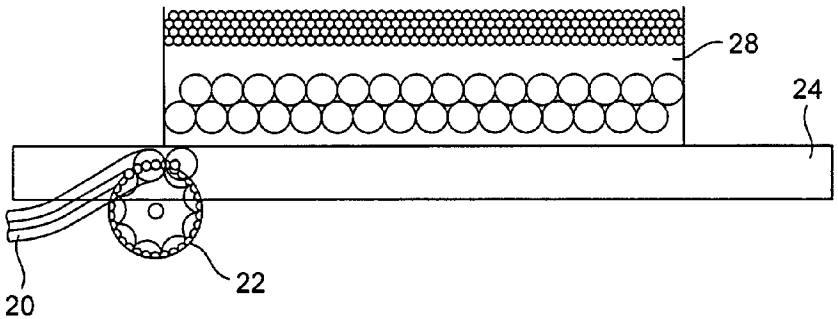
FIGS. 2(*a*) and (*b*) illustrate respective arrangements of vials prepared for loading into the freeze dryer of FIG. 1.
Figure 2B:
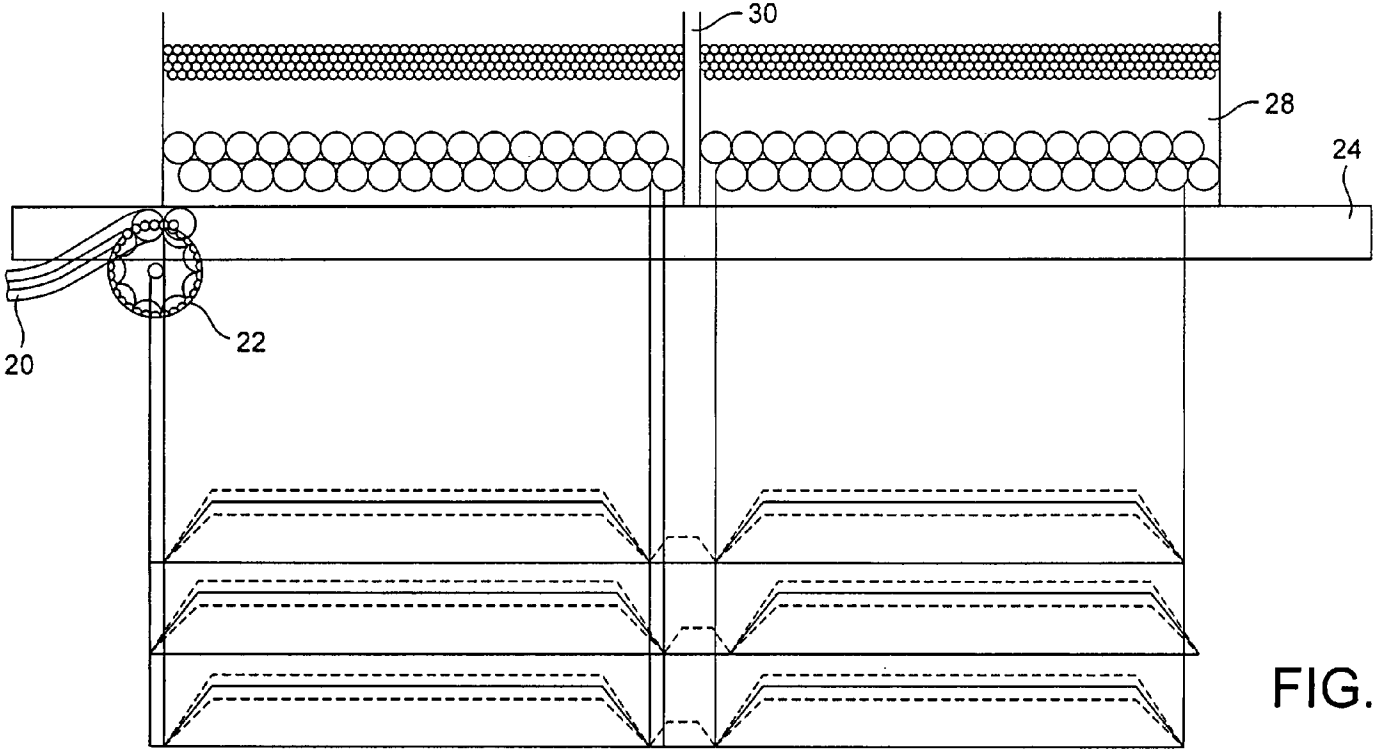

A loading pusher 26 pushes vials from the pusher conveyor 24 on to an accumulation table 28. As shown in FIG. 2(*a*), the movement of the in-feed star wheel 22 and pusher conveyor 24 can be controlled so that each row of vials accumulated on the pusher conveyor is laterally displaced from the previous row by an amount equal to one half of the vial width. This can enable close packing of the rows of vials on the accumulation table 28. As shown in FIG. 2(*b*), when loading two separate vial packs on a wide shelf 14 the in-feed star wheel 22 can form in the rows of vials a gap in the middle of the row of width equivalent to the width of a shelf guide 30. With reference to FIG. 1, the loading pusher 26 comprises a pusher bar 32 and a motorised actuating mechanism 34 connected to the pusher bar 32 for moving the pusher bar 32 towards the chamber 12 to push a row of vials on to the accumulation table 28 and for subsequently retracting the pusher bar 32 to enable another row of vials to be accumulated. For cold shelf loading, the pusher bar 32 may be provided with a mechanism for actuating a safety bar 36 that prevents vials from falling as they are pushed on to the accumulation table 28.

Figure 3:
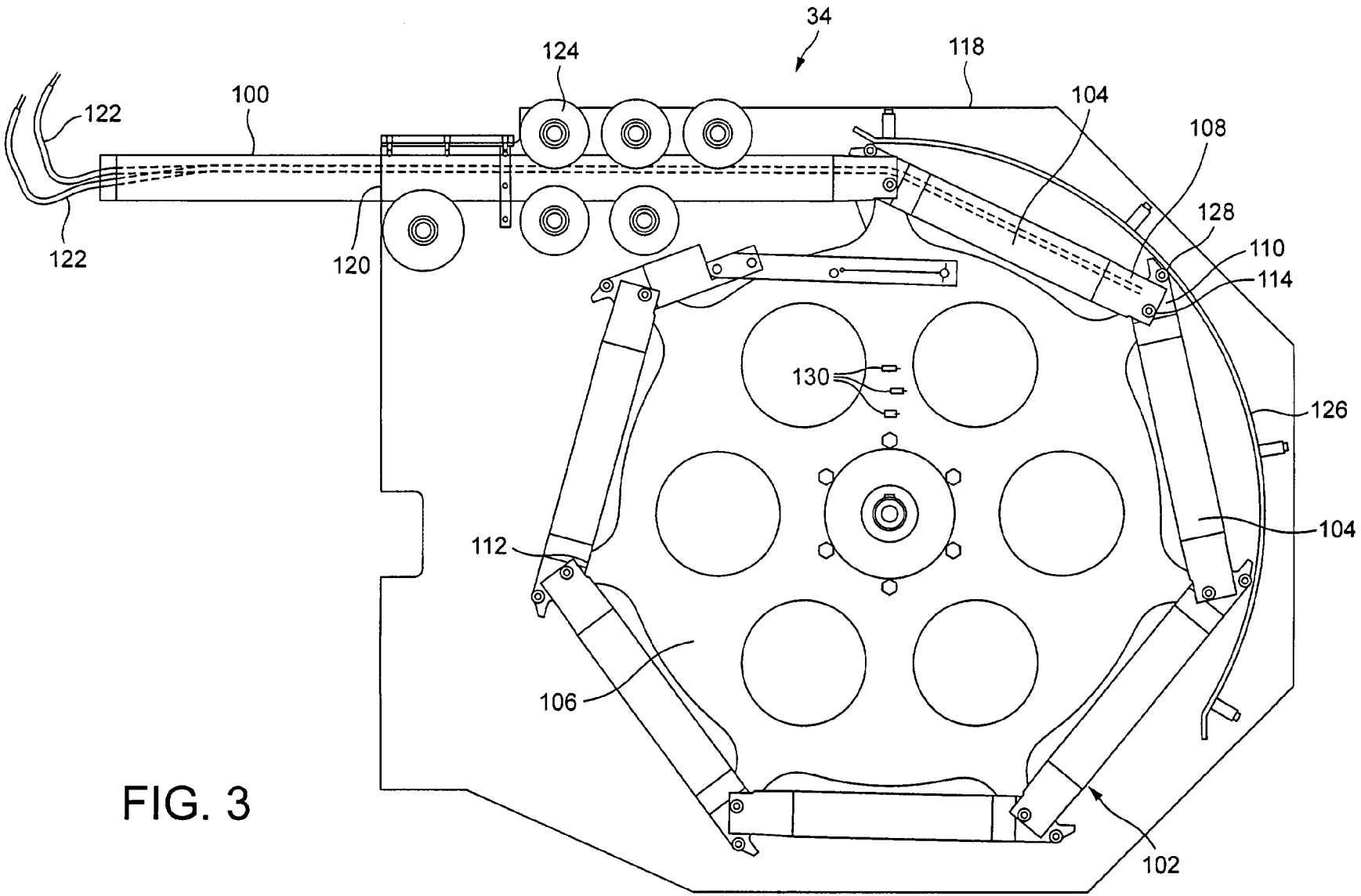
FIG. 3 is a side view of an actuating mechanism for the pusher bar of the freeze dryer of FIG. 1, with the actuating mechanism in a retracted state.
Figure 4:
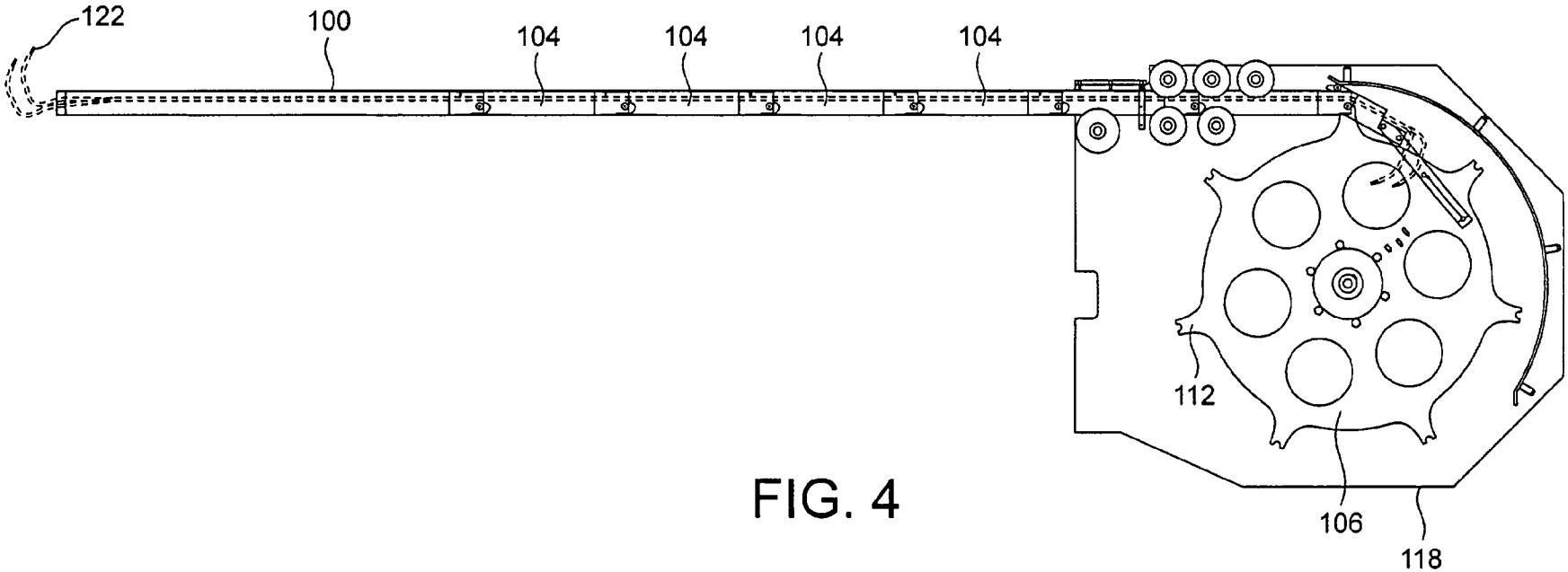
FIG. 4 is a side view of an actuating mechanism of FIG. 3 in an extended state.
Figure 5:
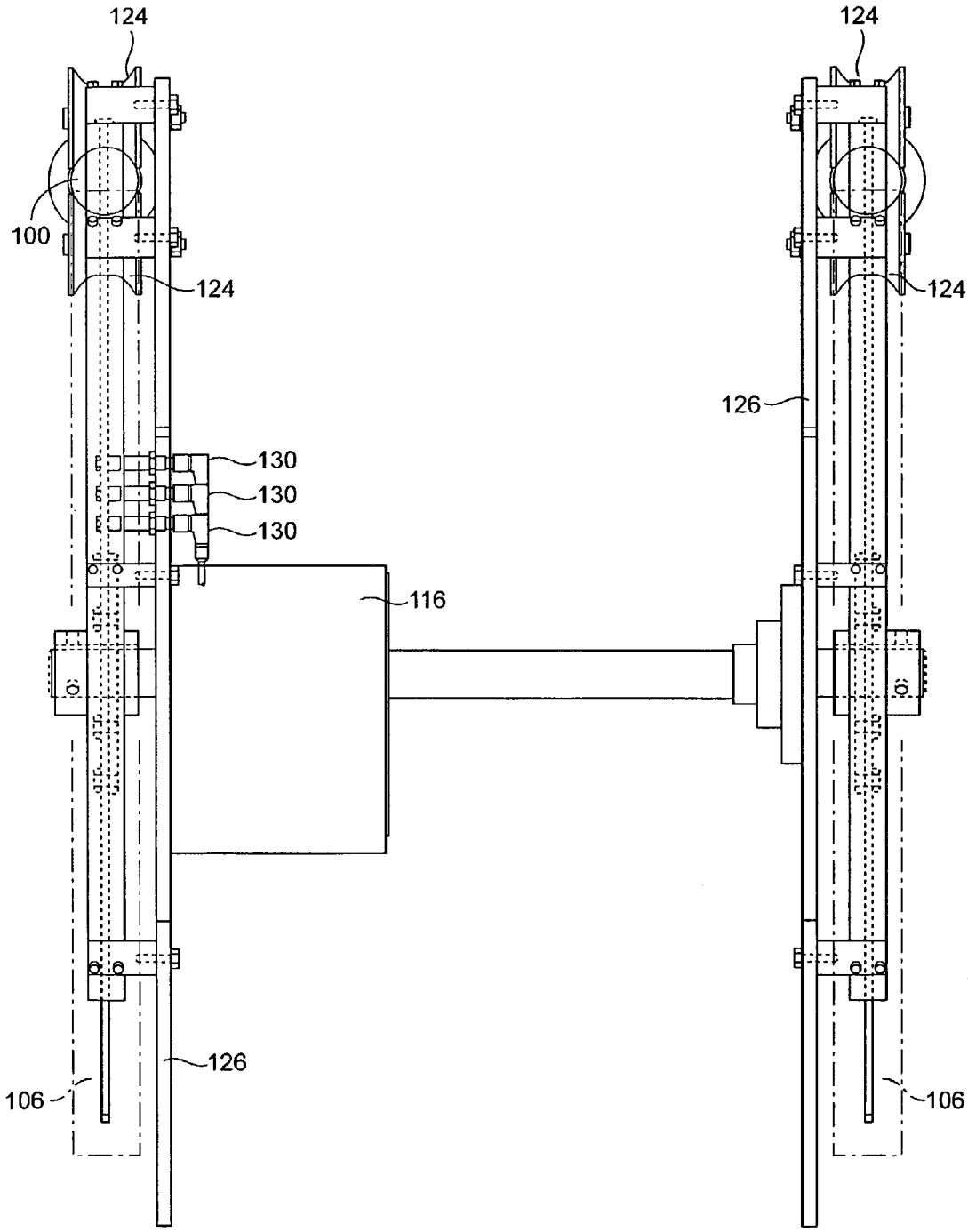
FIG. 5 is a rear view of an actuating mechanism similar to that shown in FIGS. 3 and 4 but for a wide pusher bar.

With reference to FIGS. 3 to 5, the actuating mechanism 34 for moving the pusher bar 32 towards the chamber comprises a pusher head 100 and a chain 102 of linked members 104 wound around a sprocket 106. In the embodiment shown in FIG. 3, the chain 102 comprises a plurality (six shown in FIG. 3, although the chain could comprise any number of linked members 104) of elongate tubular members 104 hinged at each end 108, 110 thereof to a respective adjacent member 104. The sprocket 106 comprises a plurality of teeth 112 each for engaging a respective hinge 114 of the chain 102. The ends 108, 110 of the tubular members 104 are designed such that the chain 102 can only be bent in one direction.

A motor is provided for rotating the sprocket 106, the sprocket 106 and motor being contained within a housing 118 having an opening 120 through the pusher head 100 protrudes when the mechanism 34 is in the retracted position shown in FIG. 3, and through which the tubular members 104 pass as the sprocket 106 is rotated to unwind the tubular members and move the pusher bar 32 into the chamber 12. The extended position of the mechanism 34 is shown in FIG. 4. Plastics bellows (not shown) may be provided for isolating the tubular members 104 and that part of the mechanism retained within the housing 118, with one end of the bellows being attached to the housing 118, and the other end of the bellows being attached to, for example, the pusher head 100 so that the bellows expands as the mechanism 34 is rotated from the retracted position. A system may be provided for periodically testing the integrity of the bellows to ensure that there is no leakage of matter from the housing into the sterile environment. Wires 122 may be fed through the pusher head 100 and one or more of the tubular members 104 for conveying control signals to the motor 116 for controlling rotation of the sprocket 106.

The mechanism 34 is also provided with guides for guiding both the pusher head 100 and the tubular members 104 as the sprocket 106 is rotated. This can ensure that the mechanism 34 is correctly aligned relative to the pusher bar 32 as the pusher bar 32 is moved into the chamber 12. The guides comprise rollers 124 for guiding initially the pusher head 100 and then the tubular members 104 as they unwound from the sprocket 106, and a guide track 126 extending, as shown in FIG. 3, at least partially around the sprocket 126 for aligning the tubular members 104 relative to the rollers 124 during rotation of the sprocket 106. Each tubular member 104 carries a roller 128 at one end thereof for engaging the guide track 126.

A number of sensors 130 are also provided for detecting that the mechanism is in one of a home position, a fully extended position and a fully retracted position, by sensing the presence of detection points provided on the sprocket 106.

FIG. 5 shows a dual actuating mechanism for moving a wider pusher bar, this mechanism comprising two arrays of tubular members each mounted on a respective sprocket 106, the sprockets 106 being rotated synchronously by a single motor 116.

Returning to FIG. 1, the accumulation table 28 is a fixed plate located adjacent the pusher conveyor 24 and forms part of a bridge plate module which enables vials to be transferred from the pusher conveyor 24 on to the shelf 14 to be loaded. The bridge plate module further includes a bridge plate 38 and an intermediate plate 40.

Figure 6:
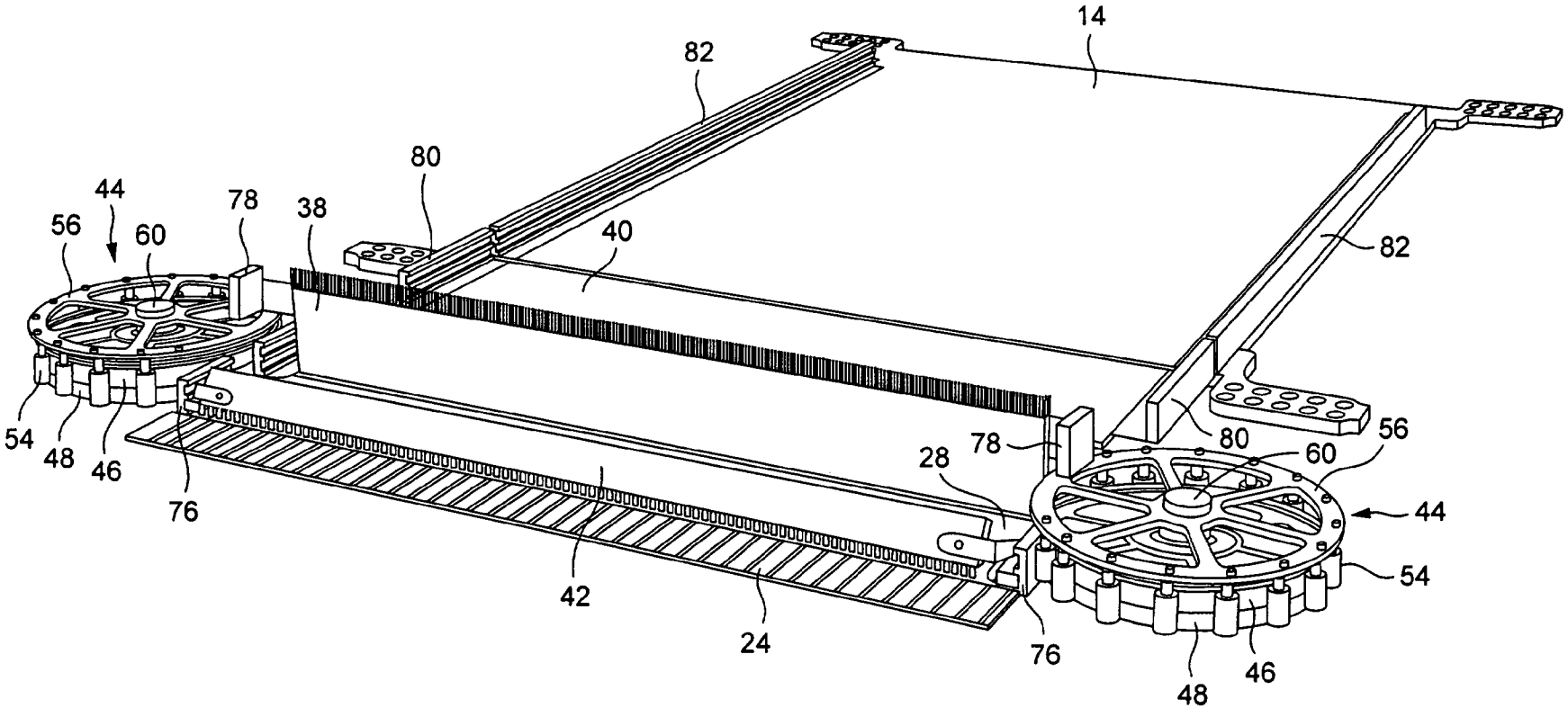
FIG. 6 is a perspective view of part of an assembly for unloading vials from the freeze dryer of FIG. 1.

As shown in FIG. 6, the intermediate plate 40 is located within the freeze dryer chamber 12 at the same level as the loading position for the shelves 14, and can automatically moved horizontally away from a filled, or emptied, shelf 14 at the loading position to enable that shelf to be raised, or lowered, within the chamber 12. The shelves may be provided with means, such as dowels or the like, which engage corresponding holes or recesses in the intermediate plate 40 to ensure accurate horizontal alignment between a shelf 14 and the intermediate plate 40 as a shelf is maneuvered into the loading position.

The bridge plate 38 is located between the accumulation table 28 and the intermediate plate 40. The bridge plate 38 can be rotated from the stowed, raised position shown in FIG. 6 relative to the accumulation table 28 and the intermediate plate 40 so that part of the bridge plate 38 extends into the chamber 12 through the slot to enable the bridge plate 38 to register and align horizontally both with the intermediate plate 40 within the chamber 12 and with the accumulation table 28 outside the chamber 12. The bridge plate 38 and intermediate plate 40 have profiled edges that mate together as the bridge plate is rotated into location with the intermediate plate 40. A mechanism for rotating the bridge plate 38 and moving horizontally the intermediate plate 40 is located beneath the bridge plate 38. Rotation of the bridge plate 38 back to the raised position can enable the slot door 16 to be closed.

Figure 7:
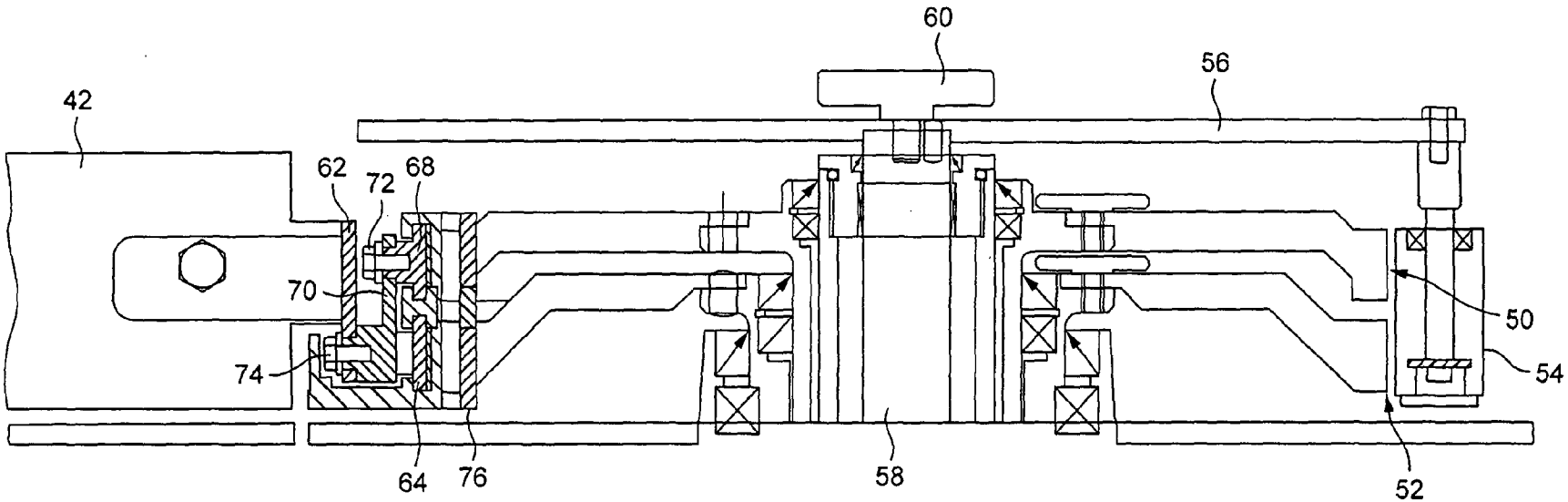
FIG. 7 is a cross-section through part of an assembly for loading vials into and/or unloading vials from the freeze dryer of FIG. 1, with the transfer bar in a lowered position.

FIG. 6 also shows a transfer bar 42 of the assembly, which, in the embodiment shown in FIG. 1, serves to unload the chamber 12. The transfer bar 42 extends substantially the width of a shelf 14, and is connected at each end to a reel assembly 44 for effecting movement of the transfer bar 42 into and out from the chamber 12, and for raising and lowering the transfer bar 42. Each reel assembly 44 comprises two stainless steel spring ribbons 46, 48. Each upper (as shown in FIG. 7) ribbon 46 is wound around an upper drum 50, and each lower ribbon 48 is wound around a lower drum 52, the upper and lower drums 50, 52 of each reel assembly 44 being co-axial. The ribbons 46, 48 are retained on the drums by rollers 54 extending about the drums 50, 52 and depending from a mounting plate 56 connected to a drive shaft 58 by a fixing member 60.

The free ends of the ribbons 46, 48 of each reel assembly 44 are connected to the transfer bar 42 via a connecting member 62 attached to the transfer bar 42 and extending substantially orthogonal therefrom. The free end of the lower ribbon 48 is rigidly attached to a first linking member 64, the first linking member 64 being pivotally attached to the connecting member 62 via pivot 66. The free end of the upper ribbon 46 is rigidly attached to a second linking member 68. The second linking member 68 is pivotally attached to a linking arm 70 via pivot 72, the linking arm being in turn pivotally attached to the connecting member 62 via pivot 74.

Movement of the first and second linking members 68, 64 as the coils are unwound from the drums is guided by guide members 76, 78, 80, 82 located on each side of the transfer bar 42. Each guide member comprises upper and lower slots, movement of the first linking member 68, and thus the free end of the upper ribbon 46, being guided by the upper slots and the movement of the second linking member 64, and thus the free end of the lower ribbon 48, being guided by the lower slots. Guide members 76 are attached to the sides of the accumulation table 28, guide members 78 are attached to the sides of the bridge plate 38, and guide members 80 are attached to the sides of the intermediate plate 40. Guide members 82 are moveable between a stowed position, shown in FIG. 6, where they are spaced from the shelf 14 to allow the shelf 14 to be raised or lowered within the chamber 12, and a deployed position where the guide members 82 are co-linear with the guide members 80. The guide members 76, 78, 80 and 82 also serve to guide the rows of vials as they are loaded into, and unloaded from, the chamber 12.

The drive shafts 58 of the reel assemblies 44 are connected to a common servomotor located beneath the supporting frame 18. Each drive shaft 58 is connected directly to the upper drum 50 of the respective reel assembly 44, the drums 50, 52 being configured such that rotation of the upper drum 50 causes both drums 50, 52 of the assembly 44 to be rotated synchronously. This enables the upper and lower ribbons 46, 48 to be simultaneously unwound from, or wound on to, the drums 50, 52 to move the transfer bar 42 into, or out from, the chamber 12 as required. The lower drum 52 can also be rotated independently from the upper drum, for example, by short stroke air cylinders provided beneath the supporting frame 18, to effect lowering and raising of the transfer bar 42.

Returning now to FIG. 1, the assembly for loading and unloading the chamber 12 also includes an out-feed conveyor 96 for collecting vials from the pusher conveyor 24. Appropriate guiding (not shown) ensures a smooth transition between these conveyors. The out-feed conveyor 96 is driven by an adjustable speed motor located beneath the supporting frame 18.

A typical sequence for loading the chamber 12 using the assembly shown in FIG. 1 will now be described.

First, the slot door 16 is raised to allow vials to be inserted into the chamber 12 through the slot formed in the chamber wall. The bridge plate 38 is rotated from the raised position shown in FIG. 3 to create a bridge between the accumulation table 28 and the freeze dryer intermediate plate 40. When the first shelf 14 to be loaded has been located at the loading position, the intermediate plate 40 is docked to the shelf 14, and the moveable guide members are moved to the deployed position shown in FIG. 1.

Vials from the filling line arrive on the in-feed conveyor 20, which acts as a buffer. When a sensor detects that the number of vials in the buffer is sufficient, the in-feed star wheel 22 transports the required number of vials to the synchronized pusher conveyor 24. This mechanism eliminates the linear errors caused by diametrical tolerance of the vials. The sprocket 106 is rotated anticlockwise to cause the pusher bar 32 to push the complete row of vials forward against the previous row of vials (if any) on the accumulation plate 28, and push the whole pack forwards by the equivalent of one vial diameter. The sprocket 106 is then rotated clockwise to withdraw the pusher bar 32 ready to push forward the next row of vials. When sufficient rows of vials to fill a shelf 14 have been assembled, the sprocket 106 is rotated anticlockwise to cause the pusher bar 32 to push the pack clear of the accumulation plate 28 and the bridge plate 38 and position the pack on the shelf 14. Alternatively, for cold shelf filling, the vials may be pushed row by row on to the shelf 14, or a number of rows of vials may be pushed at a time on to the shelf 14.

After retraction of the pusher bar 32, the moveable guide members 82 are raised and the bridge plate 38 is rotated to enable the freeze dryer to position the next empty shelf for loading. While the shelf is being positioned the next rows of vials are being assembled.

The sequence is repeated until the last shelf to be loaded. When all of the shelves have been loaded with vials, the moveable guide members 82 are raised, the intermediate plate 40 is retracted, the bridge plate 38 is raised and the slot door 16 is closed.

In the embodiment described above, the transfer bar 42 is used to subsequently unload the vials from the chamber 12. In a second embodiment shown in FIG. 8, a second pusher bar 32*a* and actuating mechanism 34*a* are provided on the opposite side of the chamber 12 to the pusher bar 32 and actuating mechanism 34 for unloading the vials from the chamber 12. As the pusher bar 32*a* is located within the chamber 12 during the freeze drying process, the pusher bar 32*a* is formed from material which is able to withstand typical freeze drying conditions, that is, water at a temperature of up to 80° C. and steam at a temperature of up to 121° C. Stainless steel bellows (not shown) are also provided for isolating from the environment of the freeze dryer that part of the pusher head of the mechanism 34*a* which extends into the chamber 12 when the pusher bar 32*a* is in the fully retracted position. Furthermore, in this embodiment the moveable guide members 82 are replaced by similar shaped guide members 98 fixed to each shelf 14 for guiding the vials as they are loaded into and unloaded from the chamber 12.

Figure 8:
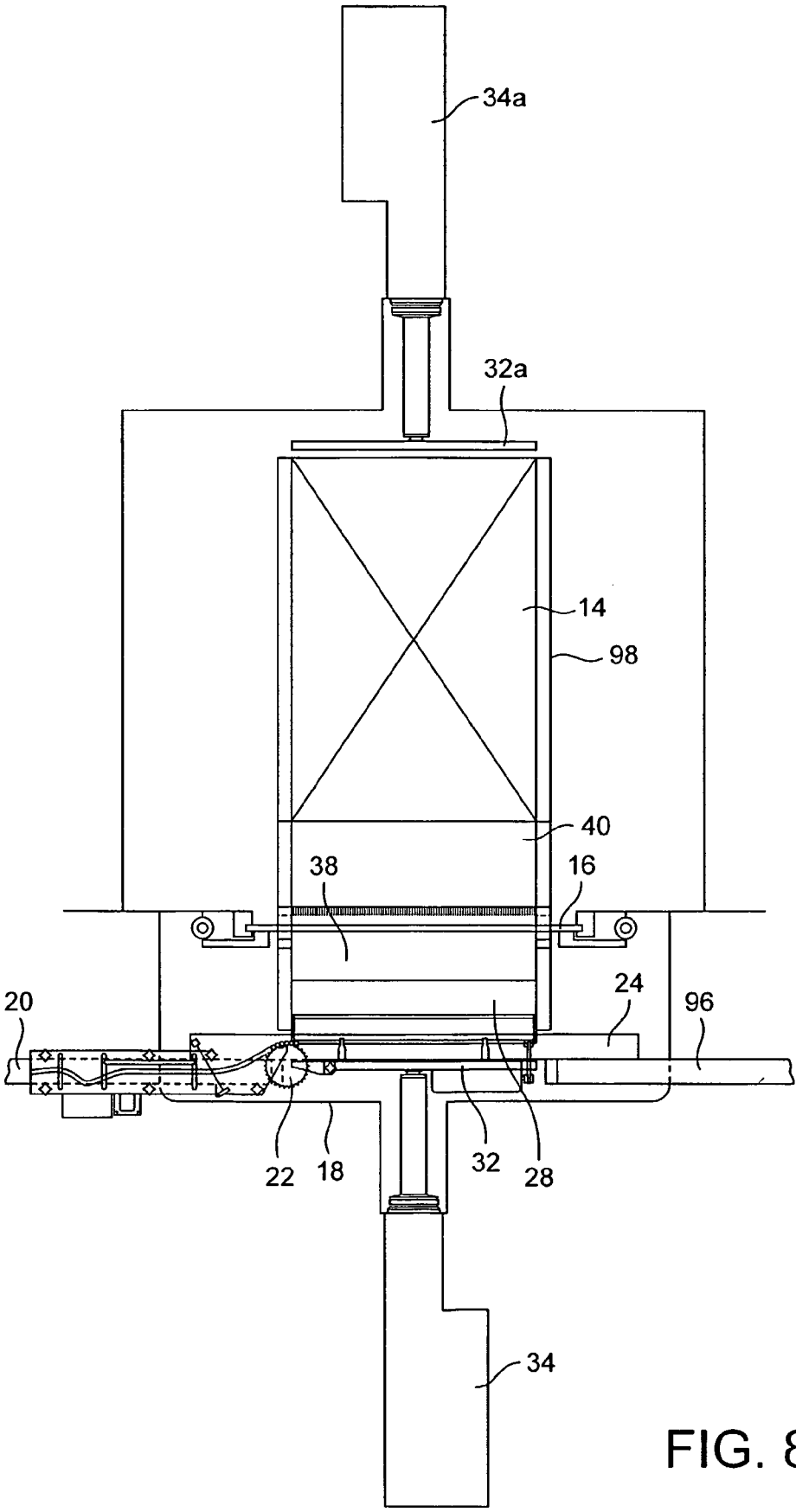
FIG. 8 is a plan view of a second embodiment of a freeze dryer.

A typical sequence for unloading the chamber 12 using the assembly shown in FIG. 8 will now be described. First, the slot door 16 is raised to allow vials to be removed from the chamber 12 through the slot formed in the chamber wall. When the first shelf 14 to be unloaded has been located at the loading position, the intermediate plate 40 is docked to the shelf 14. The bridge plate 38 is then rotated to the horizontal position to create a bridge between the accumulation table 28 and the freeze dryer intermediate plate 40. The sprocket of the mechanism 34*a* is then rotated to cause the pusher bar 32*a* to push the pack of vials out from the chamber 12 on to the pusher conveyor 24. The pusher bar 32*a* is then retracted, and the intermediate plate 40 is undocked to enable the freeze dryer to position the next shelf for unloading. The cycle is repeated until the final shelf has been unloaded, whereupon the bridge plate 38 is raised and the slot door 16 lowered to close the slot.

In summary, a freeze dryer comprises a chamber having a rectangular slot through which vials are inserted into the chamber. An assembly for loading the chamber comprises a bar extending across the slot to engage vials to be inserted into the chamber. The bar is attached to a mechanism for moving the bar laterally into and out from the chamber. In a retracted position of the bar, at least part of the mechanism is wound around a sprocket. Rotation of the sprocket unwinds the mechanism to move the bar into the chamber.

While the forgoing description and drawings represent the preferred embodiments of the present invention, it will be apparent to those skilled in the art that various changes and modifications may be made therein without departing from the true spirit and scope of the present invention.

I claim:

1. An assembly for loading vials into or unloading vials from a chamber of a freeze dryer, the assembly comprising a bar for engaging vials, and moving means for effecting lateral movement of the bar, wherein in a retracted position of the bar, at least part of the moving means is wound at least 180° around a wheel, the assembly comprising drive means for rotating the wheel to unwind the moving means from the wheel and effect the movement of the bar.

2. The assembly according to claim 1, wherein in the retracted position of the bar, the moving means is wound at least 270° around the wheel.

3. The assembly according to claim 1, wherein said at least part of the moving means comprises a plurality of hinged members wound about the wheel.

4. The assembly according to claim 3, wherein each hinged member comprises a tubular member hinged at each end thereof to a respective adjacent tubular member.

5. The assembly according to claim 4, comprising supply means for supplying control signals to the drive means, the supply means passing through at least one of the tubular members.

6. The assembly according to claim 3, wherein the wheel comprises engagement means for engaging the hinges of the hinged members.

7. The assembly according to claim 6, wherein the engagement means comprises a plurality of radically extending teeth profiled to receive the hinges.

8. The assembly according to claim 1, comprising guide means for guiding the moving means during rotation of the wheel.

9. The assembly according to claim 8, wherein the guide means is arranged to align the moving means relative to the bar.

10. The assembly according to claim 8, wherein the guide means comprises a guide track extending about at least part of the wheel.

11. The assembly according to claim 10, wherein the moving means comprises a plurality of rollers for engaging the guide track.

12. The assembly according to claim 1, wherein the wheel is located with a housing having an opening through which the moving means passes during rotation of the wheel.

13. A freeze dryer comprising a chamber and at least one assembly according to claim 1 for loading vials into or removing vials from the chamber.

14. The freeze dryer according to claim 13, wherein the assembly is arranged to load or unload the chamber through a slot provided in the chamber.

15. An assembly for loading vials into or unloading vials from a chamber of a freeze dryer, the assembly comprising a bar for engaging vials, and moving means for effecting lateral movement of the bar, wherein in a retracted position of the bar, at least part of the moving means is wound around a wheel, the assembly comprising drive means for rotating the wheel to unwind the moving means from the wheel and effect the movement of the bar, wherein said at least part of the moving means comprises a plurality of hinged members wound about the wheel, and wherein each hinged member comprises a tubular member hinged at each end thereof to a respective adjacent tubular member.

16. The assembly according to claim 15, further comprising supply means for supplying control signals to the drive means, the supply means passing through at least one of the tubular members.

17. The assembly according to claim 15, wherein the wheel comprises engagement means for engaging the hinges of the hinged members.

18. The assembly according to claim 17, wherein the engagement means comprises a plurality of radically extending teeth profiled to receive the hinges.

* * * * *